US007581723B2

(12) United States Patent
Hascup

(10) Patent No.: US 7,581,723 B2
(45) Date of Patent: Sep. 1, 2009

(54) PERSONALIZING AND INSERTING ARTICLES FOR MASS DISTRIBUTION

(75) Inventor: Alan Hascup, Bloomingdale, NJ (US)

(73) Assignee: Myron Corp., Maywood, NJ (US)

( * ) Notice: Subject to any disclaimer, the term of this patent is extended or adjusted under 35 U.S.C. 154(b) by 197 days.

(21) Appl. No.: 11/553,829

(22) Filed: Oct. 27, 2006

(65) Prior Publication Data

US 2008/0143031 A1 Jun. 19, 2008

(51) Int. Cl.
*B41F 13/54* (2006.01)

(52) U.S. Cl. ..... 270/1.03; 270/1.02; 270/52.02; 53/569

(58) Field of Classification Search ..... 270/1.01, 270/1.02, 1.03, 52.02, 52.03; 53/428, 429, 53/558, 569

See application file for complete search history.

(56) References Cited

U.S. PATENT DOCUMENTS 5,159,385 A * 10/1992 Imamura ..... 355/28

* cited by examiner

*Primary Examiner*—Ren Yan
(74) *Attorney, Agent, or Firm*—Notaro & Michalos P.C.

(57) ABSTRACT

An apparatus for personalizing and inserting articles for mass distribution, includes an envelope hopper for holding a plurality of envelopes which each carry a unique machine readable code associated with a unique individual. An article hopper holds a plurality of articles for the individuals. A code scanner reads the codes and an envelope feeder moves one envelope at a time to the scanner. The envelopes are conveyed from the scanner in sequence to an inserting station and a printer reacting to the scanner prints personal information on the articles, each corresponding the an individual for whom a code has been read by the scanner. The printed articles are then feed in the same sequence to the inserting station and are inserted into a corresponding envelope.

5 Claims, 4 Drawing Sheets

PERSONALIZING AND INSERTING ARTICLES FOR MASS DISTRIBUTION

FIELD AND BACKGROUND OF THE INVENTION

The present invention relates generally to the field of material handling, and in particular to a new and useful apparatus and method of printing personalized information on an article such as a calendar or pen, and stuffing that article into an envelope that is addressed to that person, on a mass production basis.

The most pertinent patents to the present invention that were found are:

| U.S. Pat. No. | Inventor(s) |
|---|---|
| 3,485,208 | Hemming |
| 3,503,488 | Stone |
| 3,902,712 | Dorer |
| 4,079,576 | Morrison, et al. |
| 4,158,835 | Miura, et al. |
| 4,582,312 | Abrams, et al. |
| 4,733,856 | Gunther, Jr. |
| 4,797,832 | Axelrod, et al. |
| 4,865,304 | VanderSyde, et al. |
| 4,955,185 | Haas, et al. |
| 5,034,985 | Keough |
| 5,072,922 | Paulson |
| 5,107,656 | Katz, et al. |
| 5,125,124 | Orsinger, et al. |
| 5,157,243 | Ramsey |
| 5,179,522 | Scribe |
| 5,317,654 | Perry, et al. |
| 5,388,388 | Belec, et al. |
| 5,445,367 | Long |
| 5,519,624 | Hidding |
| 5,569,003 | Goldman, et al. |
| 5,618,375 | Suzuki, et al. |
| 5,715,653 | Weinmann, et al. |
| 5,898,153 | Lagan, et al. |
| 5,954,323 | Emigh, et al. |
| 6,168,008 | Sting, et al. |
| 6,725,126 | Doery |
| 6,974,034 | Smith, et al. |
| 7,000,364 | Middelberg, et al. |
| 7,051,496 | Heilman. |

The most pertinent patent application found is U.S. Patent Application Pub. No. 2006/0162584 to Iwamoto, et al.

U.S. Pat. No. 3,503,488 to Stone and U.S. Pat. No. 3,485,208 to Hemming, et al. disclose a rotating fluted drum for transporting rod-like articles for processing.

U.S. Pat. No. 4,079,576 to Morrison, et al. discloses an insert track which comprises continuously-moving constant speed conveyor chains with spaced sets of pusher pins for carrying inserts to the stuffing station. The envelope stopped at the stuffing station is held open with sucker feet and boxing fingers, and the pusher arms is used to drive the insert into the open envelope. This patent also discloses that the stuffed envelope is processed and deposited on an envelope stacking rack.

U.S. Pat. No. 4,158,835 to Miura, et al. generally discloses a device for detecting postal information located inside a window area of an envelope.

U.S. Pat. No. 4,582,312 to Abrams, et al. generally discloses an apparatus adapted to obtain a signal from information bearing marks on a first document, transmit the signal to a printer to print an image such as a bar code on a second document, and insert the first and second documents into an envelope.

U.S. Pat. No. 4,865,304 to VanderSyde, et al. discloses directing a jet of air under and against the flap of an envelope to deflect the flap to an opened position and placing a flap retaining bar before the envelope insertion station to maintain the flap in the opened position.

U.S. Pat. No. 6,725,126 to Doery generally discloses an apparatus for matching mailing envelopes and inserts which comprises a document feeder for feeding a document to a scanner, which reads the document to obtain information and transmits the information to a controller, and a printer for printing information obtained from the controller onto the envelope.

U.S. Pat. No. 5,519,624 to Hidding generally discloses a system which scans the barcode printed on a main document, processes the signal from the scanner, and transmits the appropriate printing instructions to the printer to print the desired enclosure documents.

U.S. Pat. No. 5,317,654 to Perry, et al. generally discloses an apparatus for reading the name and address of the recipient shown on a primary document and imprinting the envelope with the information obtained from the primary document.

U.S. Pat. No. 5,618,375 to Suzuki, et al. discloses an envelope hopper assembly which pulls the envelope one by one from the bottom of the stack and deposits the envelope on the gripper of the envelope transport chain.

U.S. Pat. No. 5,072,922 to Paulson discloses an envelope hopper assembly which comprises a reciprocating rotatable vacuum drum with vacuum outlet openings and configured to remove one envelope at a time from the bottom of the envelope hopper.

SUMMARY OF THE INVENTION

It is an object of the present invention to provide an apparatus and a method for personalizing and inserting articles for mass distribution, comprising: an envelope hopper for holding a plurality of envelopes which each carry a unique machine readable code associated with a unique individual; an article hopper for holding a plurality of articles for the individuals; a code scanner for reading the unique machine readable codes of the envelopes; an envelope feeder for moving one envelope at a time to the scanner for reading each machine readable code; an envelope conveyor for conveying the envelopes from the scanner and in a sequence corresponding to the order in which the codes were scanned, to an inserting station; a printer operatively connected to the scanner for printing personal information on articles, each corresponding the an individual for whom a code has been read by the code scanner; an article feeder for feeding articles from the article hopper to the printer for being printed with the personal information, and for feeding the printed articles in the same sequence to the inserting station; and inserting means at the inserting station for inserting each article that has been printed with personal information, into a corresponding envelope from which the unique code has been read by the scanner.

The invention achieves the correlation of uniquely printed articles such as, but not limited to calenders and pens, into correspondingly addressed envelopes, by reading the unique codes in sequence and by observing the same sequence for the envelopes and for the articles, by discharging any envelopes with an unsuccessfully read code, and either not printing a corresponding article or, if the article has already been printed, discharging that article from the article sequence as well.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
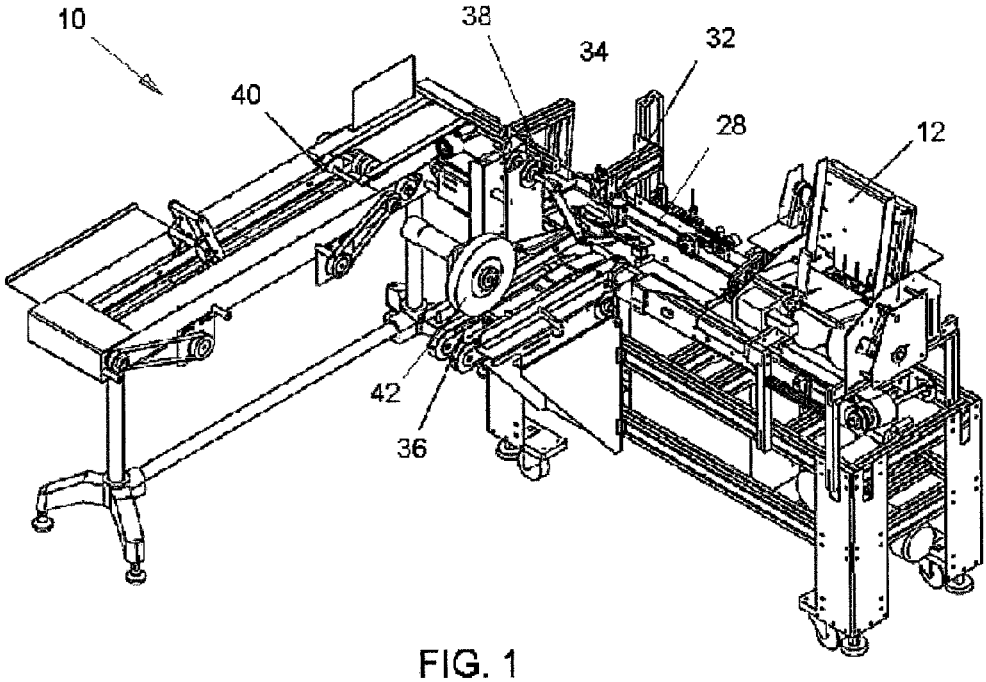
FIG. 1 is a partial perspective view of one embodiment of the invention.

Referring to the drawings, in which like reference numerals are used to refer to the same or similar elements, FIG. 1 shows the invention as an apparatus 10 for personalizing articles, such as writing instruments or journals, for mass distribution by imprinting recipient-specific information directly on a surface of the article, associating each personalized article with a corresponding pre-filled envelope, and inserting each personalized article into the corresponding envelope. The stuffed envelopes are then advanced downstream for further processing, e.g., closing the envelope flap and printing postage.

Figure 2:
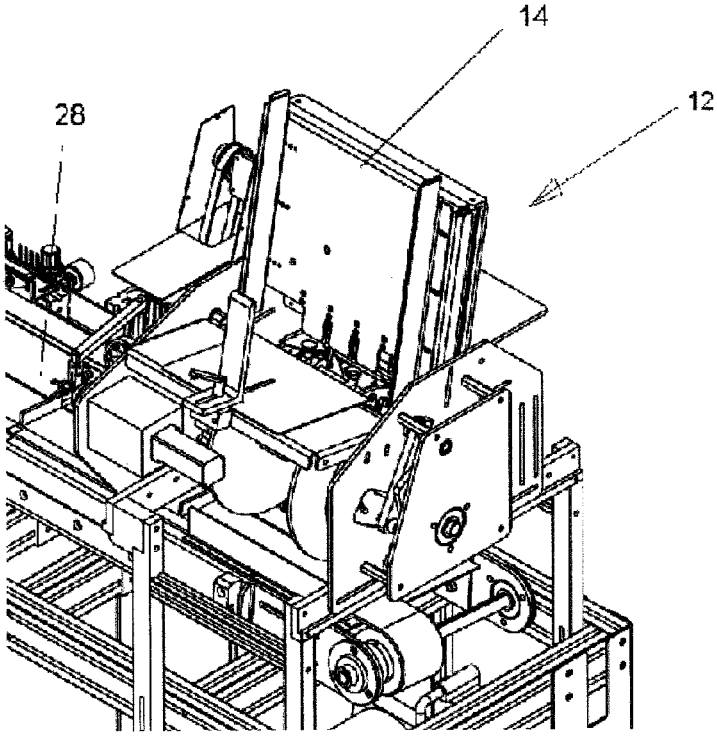
FIG. 2 is an enlarged perspective view of an envelope hopper of the embodiment of FIG. 1.
Figure 3:
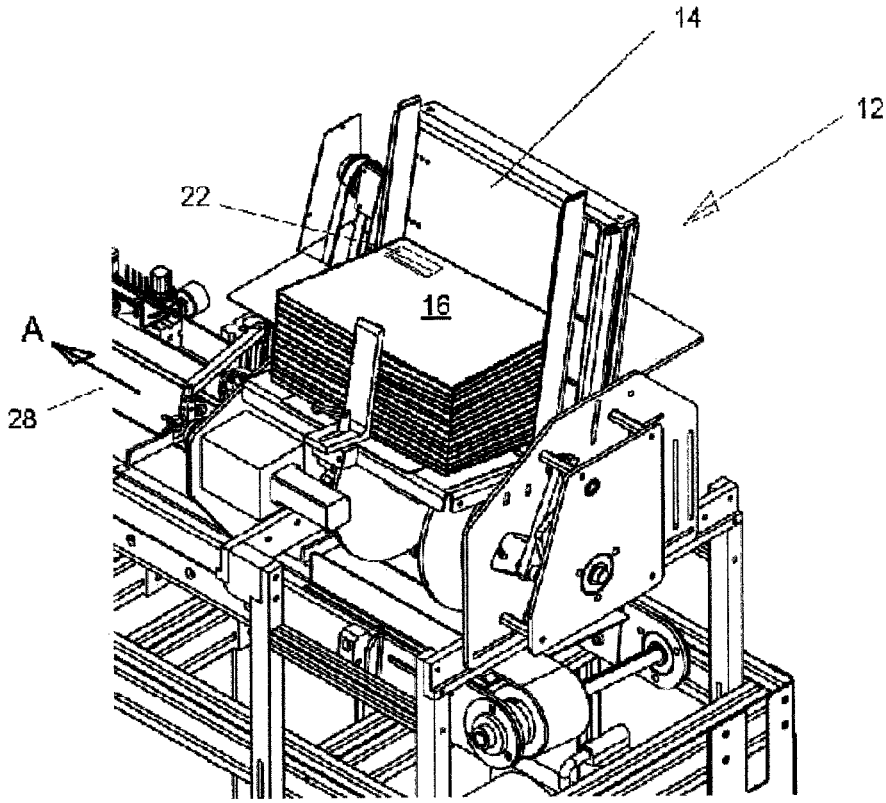
FIG. 3 is a view similar to FIG. 2 with a stack of envelopes in the hopper.

The apparatus 10 includes an envelope feeder assembly 12 which comprises an envelope hopper 14 shown empty and on an enlarged scale in FIG. 2, for stacking a plurality of envelopes 16 shown in the hopper in FIG. 3. A rotary drum 18 is positioned below the envelope hopper 14 for pulling envelopes 16, individually from the bottom of the stack on the hopper. The rotary drum 18 also rotates to position the envelope adjacent a scanner shown at 20 in FIG. 5 which is behind the hopper 14, and the drum holds the envelope to allow the scanner to scan the machine readable code 22 shown in FIG. 3, e.g. a data matrix or other know or to be discovered machine readable code that is printed on or displayed through the window of the envelope 16. Preferably, the amount of time the envelope 16 is held in front of the scanner 20 is sufficient to permit multiple reads of the machine readable code to minimize reading errors.

Scanners capable of reading and/or decoding one or more of the following machine readable codes may also be used: 3-DI, ArrayTag, Aztec Code, Codablock, Code 1, Code 16K, Code 49, CP Code, DataGlyphs, Datastrip Code, Dot Code, A hueCode, INTACTA.CODE, MaxiCode, MiniCode, PDF 417, QR Code, SmartCode, SuperCode, Snowflake Code, and Ultracode.

The envelopes 16 are preferable pre-filled with documents which contain some form of addressee information in machine readable code printed on the portion of the document which is displayed through the window of the envelope. Proper orientation of the envelopes 16 in the hopper so that the window of the envelope will face the scanner 20 is within the capability of those skilled in the art.

Figure 5:
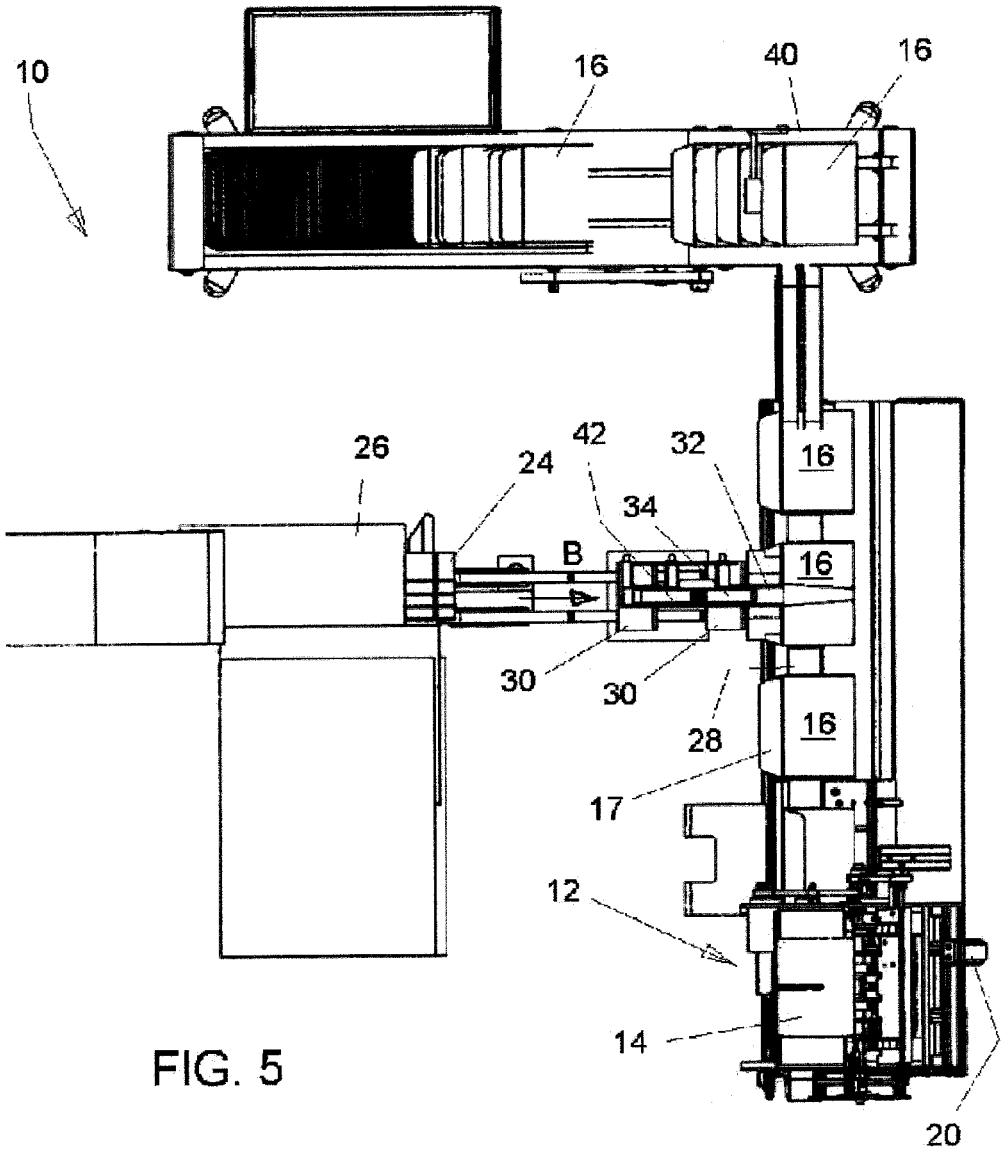
FIG. 5 is a top plan view of one version of the embodiment of FIG. 1 with an article hopper and printed for use therewith.

The scanner 20, such as a Microscan scanner, decodes the machine readable code and sends the data to a printing or engraving device 24 in FIG. 5, where imprinting of personalized information on the article is triggered by signals transmitted by the scanner 20. The type of imprinting machine used depends on the type of article being imprinted. For example, thermal transfer printers or Fleisher printers (foil stamping) are suitable for printing personalized information on the plastic covers of journals stacked, for example in an article hopper 26. For writing instruments with metallic bodies, laser engraving machines may be used. Dot-matrix and any other suitable printer may also be used with the invention.

Any envelope 16 from the stack in envelope hopper 14, that cannot be scanned for any reason, e.g. a defect in the information 22, is discarded so that only the next set of information corresponding to the next successfully scanned envelope is used to print the article that is destined for that envelope.

After the scanning operation at scanner 20, the successfully scanned envelope is placed with its front or printed, code bearing side facing down, on an intermittently operating pusher chain or envelope conveyor 28 with evenly spaced chain fingers or projections. The envelope is also indexed to synchronize the movement of the envelope in the direction of arrow A in FIG. 3, and the corresponding personalized article 30, in the direction of arrow B shown in FIG. 5, to ensure that the matching mail pieces arriving at an inserting station 32, together. Air nozzle 34 that injects high velocity air into the open top of the envelope in station 32, is used to open the envelope. Before the envelope moves into the inserting station 32, the envelope flap 17 is contacted with a metal edge plate attached to a support beam that runs parallel to the pusher chain 28. The envelope flap 17 is gradually deflected outwardly and under the edge plate to unfold the flap and open envelope as it approached station 32.

Figure 4:
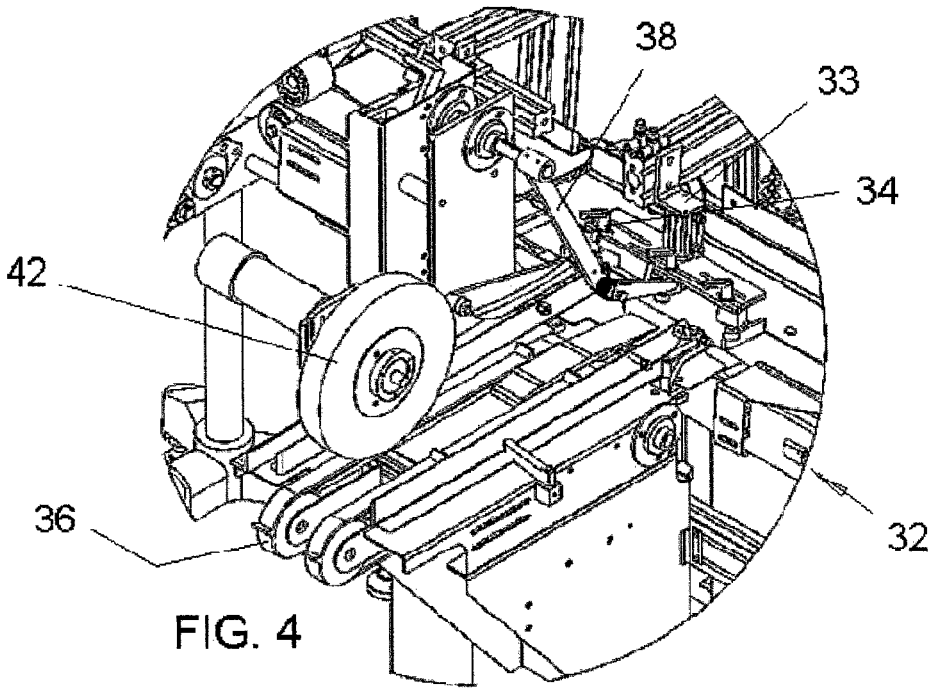
FIG. 4 is an enlarged perspective view of an article feeder and inserting station of the embodiment of FIG. 1.

As shown in FIG. 4 which is an enlarged view of the inserting station 32, the envelope 16 stops at the inserting station 32 with the flap 17 tucked or deflected below one or more parallel flap retaining plates. An article transport belt or feeder 36 with evenly spaced teeth or projections is arranged to run perpendicular to the pusher chain 28 and in the direction of arrow B in FIG. 5, and carries the personalized article 30 corresponding to the recipient of the content of the envelope to the inserting station 32, i.e., in front of the envelope opening.

A piston driven suction member 33 comprising a plurality of suction cups at station 32, move downwardly to engage the suction cups against the back side of the envelope at station 16, that is the upwardly facing side. The suction cups are then raised to hold the back side of the envelope open. The personalized article 30 is then pushed into the envelope with a pushing arm 38 that is actuated by a lever mechanism at the correct time when the appropriately printed article 30 is on the belt 36 just in front of the open mouth of the corresponding envelope 16.

The thus stuffed envelope is then moved forward again in the direction of arrow A, on chain 28, and deposited on a mail accumulator assembly 40 configured to stand the envelopes vertically.

When the apparatus of the invention is combined with a thermal transfer printer or Fleisher printer 24, a pull-off device may be used to slide the personalized article from the output tray of the printer and onto the article transport belt 28. When the article 30 is imprinted by foil stamping, a buffing wheel 42 is positioned on the article transport pathway (e.g. belt 36) to remove any foil residue from the surface of the printed article. The printing device may include an article feeder to allow continuous printing of articles.

Various printing and engraving machines, now known or hereafter developed, may be operatively associated with the article transport belt. For example, the apparatus of the present invention may be integrated with a pen engraving assembly shown in FIG. 6 which replaced article hopper and its associated parts.

Figure 6:
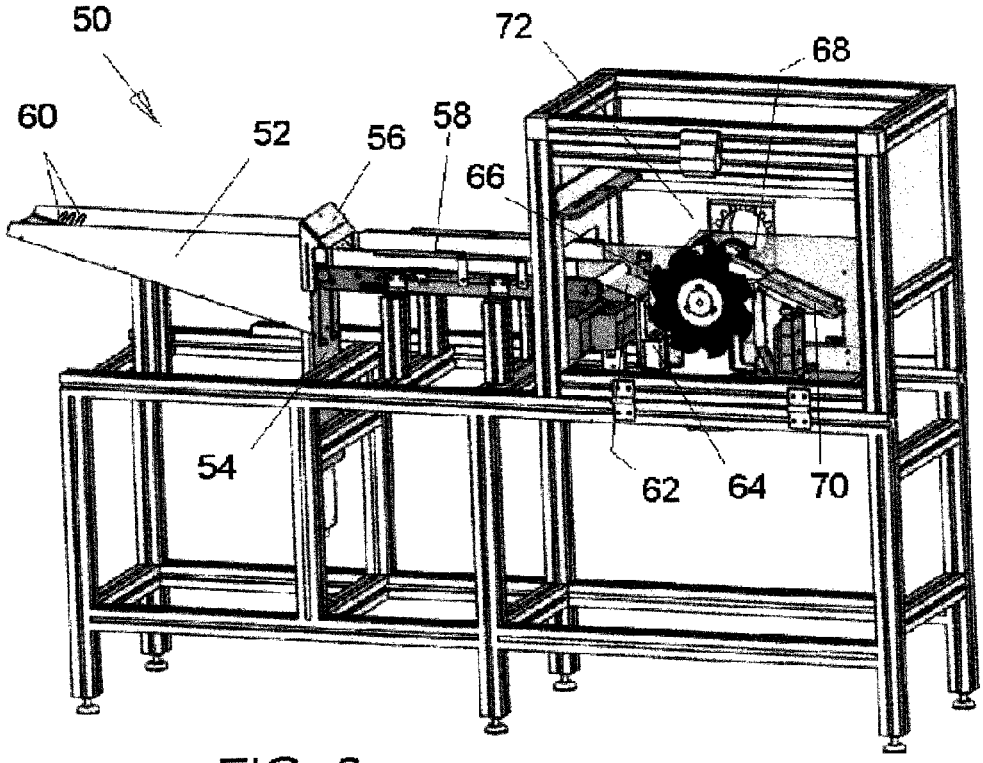
FIG. 6 is a side perspective view of another article feeder and printer for use with the embodiment of FIG. 1.

The pen engraving assembly 50 of FIG. 6, comprises an article hopper in the form of an inclined pen hopper 52 for carrying a plurality of pens 60, a first elevating plate 54 for lifting the pens individually to the top edge of a first inclined plate 56, which causes each individual pen to roll onto one end of a pen transport belt 58, which is preferably made of an elastic material. A second inclined plate 62 attached to the other end of the pen transport belt 58, then receives the pen and a second elevating plate 64 located adjacent the bottom edge of the second inclined plate 62, raises the pen to a rotating pen feeder assembly 66 having tooth structures for engaging one pen at a time. As the rotating pen feeder 66 rotates, the pen moves on to a laser engraving machine 72 where the unique information obtained by reading the code on the envelope into which the pen will eventually be inserted is imprinted on the pen, and then the pen moves on to a third inclined plate 68 with a pivoting portion 70. The pivoting portion 70 pivots counter clock-wise in FIG. 6, to discharge a printed pen from the lower edge of the plate 68, under the rotating feeder 66 and away from the inserting station, when a corresponding envelope 16 has failed to have its code successfully read by the scanner 20 and has therefore been removed from the sequence of envelopes moving along the chain 28, in order.

Each of pen receiving gaps or notches formed between the adjacent teeth of the pen feeder assembly is configured for picking up and holding one pen. The pen feeder assembly positions and orients the pen for engraving. Preferably, the pen being engraved is held at the 12 o'clock position.

The pen engraving assembly 72 also includes a senor for detecting whether the pen has the proper rotational orientation. The sensor provides an indication to the controller (e.g., Automation Direct or Mitsubishi PLC) which determines whether to allow the pen to proceed to the article transport belt or to discard any improperly aligned pen into the rejected pen chute by lifting the pivoting portion of the third incline.

Instead of using an article transport belt, the pen engraving assembly may be integrated with an intermittently operating envelope placement assembly that removes one envelope at a time from an envelope hopper, scans the machine readable code printed on the envelope (or on the document displayed through the envelope), instructs the pen engraving assembly to commence the engraving process, and places the envelope with the flap and mouth open below the third incline to receive the personalized pen which has been engraved with the information obtained from the envelope. Illustrations of the invention are shown below.

For purposes of the present invention the word envelope is uses to identify any appropriate receptacle for mailing or delivering an article, which is preferably a paper or plastic envelope with a flap that opens and closes an opening of the envelope for receiving the article, but may also be a box of wrapper of other type. The word article is used to identify any small, portable article that can be printed, embossed or otherwise marked with personal information (correctively called printing here), such as the person's name, unique or associated information like a birth date, address or other single or multiple item(s) of information associated with the intended recipient of the envelope. The concept of a unique individual is also preferably a person, but may be an organization, a company, a geographic area or other unique entity that may have an article printed with personalized information associated with that entity.

While specific embodiments of the invention have been shown and described in detail to illustrate the application of the principles of the invention, it will be understood that the invention may be embodied otherwise without departing from such principles.

What is claimed is:

1. An apparatus for personalizing and inserting articles for mass distribution, comprising:

an envelope hopper for holding a plurality of envelopes which each carry a unique machine readable code(s) associated with a unique individual;

an article hopper for holding a plurality of articles for the individuals;

a code scanner for reading the unique machine readable code(s) of the envelopes;

an envelope feeder for moving one envelope at a time to the scanner for reading each machine readable code(s);

an envelope conveyor for conveying the envelopes from the scanner and in a sequence corresponding to the order in which the unique machine readable code(s) were scanned, to an inserting station;

a printer operatively connected to the scanner for printing personal information on articles, each corresponding the an individual for whom a unique machine readable code(s) has been read by the code scanner, the printer being selected from the group consisting of: a thermal transfer printer; a laser engraving printer; dot-matrix printer; and a laser printer;

an article feeder for feeding articles from the article hopper to the printer for being printed with the personal information, and for feeding the printed articles in the same sequence to the inserting station;

inserting means at the inserting station for inserting each article that has been printed with personal information, into a corresponding envelope from which the unique machine readable code(s) has been read by the scanner, the inserting means comprising a pusher for pushing each printed article into its corresponding envelope at the inserting station;

envelope opening means at the inserting station for opening a mouth of each envelope for receiving the corresponding printed article;

holding means for holding each envelope at the inserting station; and the article hopper being an inclined hopper for carrying a plurality of articles, the article feeder comprising a first elevating plate for lifting individual articles to a top of a first inclined plate, a transport belt for moving articles from a bottom of the first inclined plate to a second inclined plate, a second elevating plate adjacent a bottom of the second inclined plate for raising each article to a rotating feeder having teeth for engaging one article at a time and for moving one article at a time past the printer, the article feeder further comprising a third inclined plate with a pivoting portion for moving each article from the rotating feeder to the inserting station, the pivoting portion pivoting to discharge a printed article away from the inserting station when a corresponding envelope has failed to have its unique machine readable code(s) successfully read by the scanner.

2. The apparatus of claim 1, wherein the printer comprises a thermal transfer printer.

3. The apparatus of claim 1, wherein the printer comprises a laser engraving printer.

4. The apparatus of claim 1, wherein the printer comprises a dot-matrix printer.

5. The apparatus of claim 1, wherein the printer comprises a laser printer.

* * * * *